US007165480B2

(12) United States Patent
Lin

(10) Patent No.: US 7,165,480 B2
(45) Date of Patent: Jan. 23, 2007

(54) HAND TOOL HAVING POSITIONING AND LOCKING JOINT

(75) Inventor: Yu-Cheng Lin, Taichung (TW)

(73) Assignee: Lea Way Hand Tool Corporation, Taichung (TW)

( * ) Notice: Subject to any disclaimer, the term of this patent is extended or adjusted under 35 U.S.C. 154(b) by 142 days.

(21) Appl. No.: 10/988,260

(22) Filed: Nov. 12, 2004

(65) Prior Publication Data

US 2005/0103168 A1 May 19, 2005

(30) Foreign Application Priority Data

Nov. 13, 2003 (CN) ..... 2003 1 0118139

(51) Int. Cl.
*B25B 23/16* (2006.01)

(52) U.S. Cl. ..... 81/177.9

(58) Field of Classification Search ..... 81/177.9, 81/177.7, 177.8, 177.85
See application file for complete search history.

(56) References Cited

U.S. PATENT DOCUMENTS 973,779 A * 10/1910 Hansen ..... 81/177.9
1,205,149 A * 11/1916 Bovee ..... 81/177.9
5,737,982 A 4/1998 Lin
6,216,317 B1 4/2001 Chen
6,216,567 B1 * 4/2001 Hu ..... 81/177.9
6,848,345 B1 * 2/2005 Lin ..... 81/177.8
6,857,341 B1 * 2/2005 Cheng ..... 81/177.8
6,957,600 B1 * 10/2005 Hu ..... 81/177.8
6,971,292 B1 * 12/2005 Hu ..... 81/177.8
2001/0000092 A1 4/2001 Jarvis
2003/0159549 A1 8/2003 Rocco
2005/0061117 A1 * 3/2005 Chen ..... 81/177.7
2005/0268753 A1 * 12/2005 Lin ..... 81/177.9

* cited by examiner

*Primary Examiner*—Hadi Shakeri
(74) *Attorney, Agent, or Firm*—Ladas and Parry LLP

(57) ABSTRACT

A hand tool having: a head provided at an end thereof with an arcuate face and a handle, connected to the head to allow rotational movement in relation to the head. The handle is formed with a first receiving hole, a second receiving hole and a third receiving hole communicating with the second receiving hole. A positioning and locking joint, including: a first stop mechanism is received in the first receiving hole, and has an end constantly urged against one of a plurality of teeth formed on the arcuate face of the head. A second stop mechanism is received in the second receiving hole and has an end selectively engaging one of the teeth on the arcuate face of the head An operative pin is received in the third receiving hole for controlling the second stop mechanism to engage with or disengage from one of the teeth.

6 Claims, 5 Drawing Sheets

HAND TOOL HAVING POSITIONING AND LOCKING JOINT

CROSS-REFERENCES TO RELATED APPLICATIONS

Not Applicable

Statement Regarding Federally Sponsored Research or Development

Not Applicable

DESCRIPTION

1. Field of Invention

This invention relates to a hand tool having a positioning and locking joint, particularly to a joint allowing a box of a pivotable wrench to be positioned with respect to a handle or to rotate about a handle.

2. Background

There have been several joint constructions for pivoting a box and a handle of a wrench to allow the box to rotate about a handle.

One of the prior art inventions implements a ball urged by a resilient member to constantly urge against one of the teeth formed on the box. When a user intends to rotate the box about the handle to a desired orientation, the user needs to apply a force to overcome the resilience of the resilient member thereby causing the ball to disengage from the tooth with which the ball originally engages, and subsequently rotate the box to cause the ball to urge against another tooth formed on the box. However, in such prior art, the coefficient of elasticity of the resilient member must be carefully selected to ensure smooth operation of the box while, at the same time, preventing fatigues of the resilient member after extended use of the box to rotate about the handle. If a resielint member having an improper coefficient of elasticity is used, the box may unintentionally rotate about the handle when the user applies excessive or improper forces in operating the wrench.

Other prior art not implementing the above-mentioned engaging ball-tooth structure includes those disclosed in Taiwan Patent Publication Nos. TW417562, TW478444 and TW525564.

In such prior art, TW 417562 and TW478444 implement an operable pushbutton for controlling a stop pin to selectively engage with or disengage from one of the teeth formed on the box. When the stop pin is disengaged from the teeth formed on the box, the user may rotate the box about the handle to a desired orientation. When the stop pin engages with one of the teeth formed on the box, the box is positioned at the selected and desired orientation. However, in such prior art, though the pushbutton may be controlled to cause the stop pin to selectively engage with or disengage from one of the teeth formed on the box, if the user does not support the box using his hand while the stop pin is disengaged from the teeth formed on the box, the box may freely rotate downwards due to the gravitational force working on the box per se. If the user intends to select an operation orientation that is close to the original operation orientation, such a downward rotation may cause the box to disengage from the original orientation significantly, which causes inconvenience to the user. In addition, because the box is allowed to freely rotate about the handle when the stop pin is disengaged from the teeth formed on the box; the user may rotate the box to an orientation that properly align, the stop pin with the desired tooth formed on the box. When the user causes the stop pin to engage with the desired tooth formed on the box at this time, the stop pin or the tooth formed on the box may be improperly worn off by the mis-alignment.

TW525564 discloses a locking device provided at a side of the handle of the tool to selectively retain a ball urged by a resilient body, thereby preventing the box from rotating about the handle in operating the wrench. Such a sideway operation also causes inconvenience to the user in operation because the user can hardly reach the sideway pushbutton with a single-hand manipulation.

SUMMARY OF INVENTION

It is a primary objective of this invention is to provide a hand tool having a positioning and locking joint allowing easy engagement and disengagement operation of the head of the hand tool by the user.

It is another objective of this invention to provide a hand tool having a positioning and locking joint that prevents downward rotation of the head due to the gravitational force working on the head per se when the user rotates the head about the handle of the hand tool.

It is a further objective of this invention to provide a hand tool having a positioning and locking joint that ensures proper alignment between the stop pin and the teeth formed on the hand under any orientation, so as to prevent improper wear caused to the teeth and the stop pin.

To achieve the above objectives, this invention provides a hand tool having a positioning and locking joint, comprising: a head provided at an end thereof with an arcuate face, on the arcuate face being formed with a plurality of teeth; a handle, connected to the head in a manner allowing rotating movement in relation to the head, the handle being formed with a first receiving hole, a second receiving hole and a third receiving hole communicating to the second receiving hole; and a positioning and locking joint, including: a first stop mechanism received in the first receiving hole, the first stop mechanism having an end constantly urging against one of the teeth formed on the head; a second stop mechanism received in the second receiving hole, the second stop mechanism having an end selectively engaging one of the teeth formed on the head; and an operative pin received in the third receiving hole for controlling the second stop mechanism to engage with or disengage from one of the teeth formed on the head.

According to one aspect of this invention, the hand tool having a positioning and locking joint is characterized in that: the first stop mechanism includes a first resilient member; and a ball, located at an open end of the first receiving hole and resiliently urged by the first resilient member so as to resiliently urge against one of the teeth formed on the head.

According to one aspect of this invention, the hand tool having a positioning and locking joint is characterized in that: the second stop mechanism includes a second resilient member; and a stop pin, located at an open end of the second receiving hole and resiliently urged by the second resilient member, the stop pin being formed thereon with a slot through which the operative pin received in the third receiving hole inserts.

According to one aspect of this invention, the hand tool having a positioning and locking joint is characterized in that: the operative pin is formed at a location where the operative pin contacts the stop pin, with an indent and a slope extending from an indent bottom towards a periphery of the operative pin.

According to one aspect of this invention, the hand tool having a positioning and locking joint is characterized in that: the head is formed with a lip projecting from an end thereof, on the lip being formed with the arcuate face, and the head is formed with a recess on an end of the handle connected to the head for receiving the lip.

According to one aspect of this invention, the hand tool having a positioning and locking joint is characterized in that: the lip of the head and the recess of the handle are each formed with at least one axial hole through which a shaft passes.

According to one aspect of this invention, the hand tool having a positioning and locking joint is characterized in that: the teeth are parallel to one another.

These and other modifications and advantages will become even more apparent from the following detained description of a preferred embodiment of the invention and from the drawings in which:

DETAILED DESCRIPTION OF THE INVENTION

Figure 1:
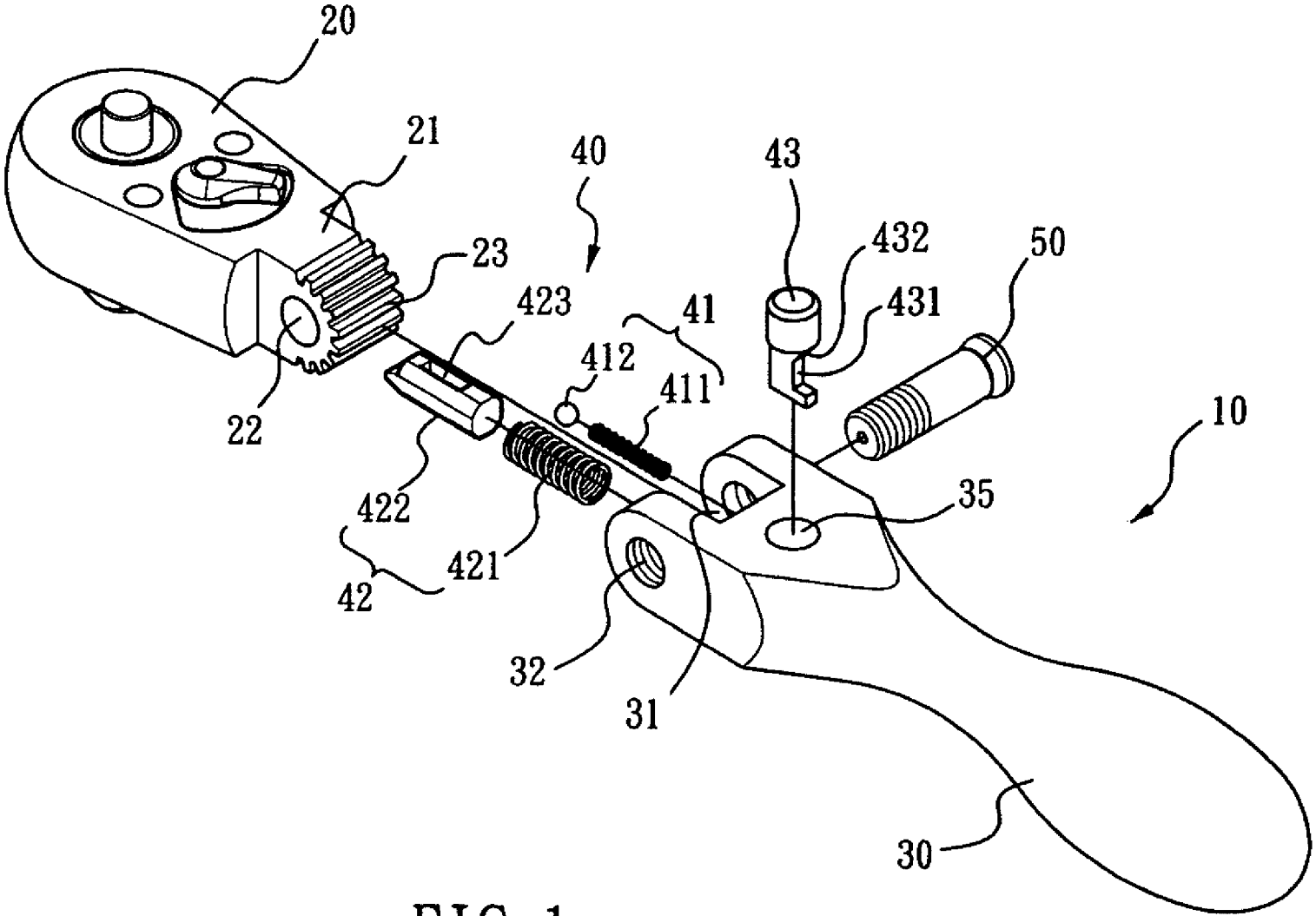
FIG. 1 illustrates an exploded, perspective view of the hand tool having a positioning and locking joint according to this invention.
Figure 2:
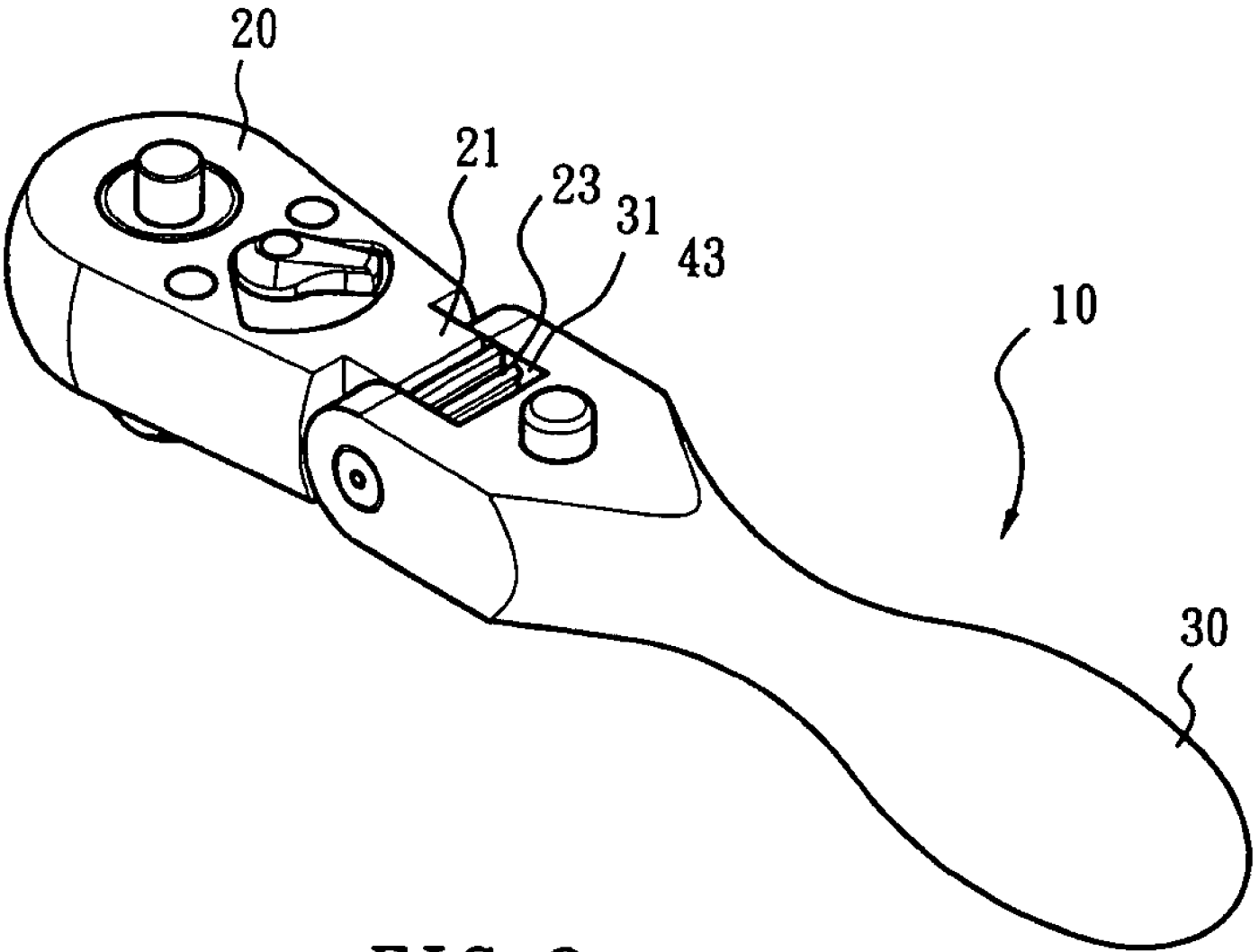
FIG. 2 illustrates an assembled, perspective view of the hand tool having a positioning and locking joint according to this invention.

FIGS. 1 and 2 illustrate the perspective views of the hand tool having a positioning and locking joint according to this invention. The hand tool as illustrate is a wrench 10; the hand tool may also be any other suitable hand tool.

With reference to FIGS. 1 and 2, the wrench 10 includes: a head/box 20, a handle 30, and a positioning and locking joint 40.

An end of the head 20 connecting to the handle 30 is provided with a lip 21 having an arcuate face. An end of the handle 30 connecting to the head 20 is provided with a recess 31 for receiving the lip 21. The lip 21 and the recess 31 are each formed with axial holes 22, 32 through which a shaft 50 may pass, such that the head 20 is connected to the handle 30 in a manner allowing rotating movement therebetween, The arcuate face of lip 21 is formed thereon with a plurality parallel teeth 23. The recess 31 is formed at an inside thereof with a first receiving hole 33 and a second receiving hole 34 (FIG. 3); the handle 30 is formed thereon with a third receiving hole 35 communicating with the second receiving hole 34.

The positioning and locking joint 40 includes: a first stop mechanism 41, received in the first receiving hole 33, the first stop mechanism 41 having an end constantly and resiliently urging against one of the teeth 23 formed on the lip 21 of the head 20; a second stop mechanism 42 received in the second receiving hole 34, the second stop mechanism 42 having an end selectively engaging one of the teeth 23 formed on lip 21 of the head 20; and an operative pin 43 received in the third receiving hole 35 for controlling the second stop mechanism 42 to engage with or disengage from one of the teeth 23 formed on the lip 21 of the head 20.

According to the embodiment as illustrated, the first stop mechanism 41 includes: a first resilient member 411 and a ball 412. The ball 412 is located at an open end of the first receiving hole 33 and resiliently urged by the first resilient member 411, so as to resiliently urge against one of the teeth 23 formed on the lip 21 of the head 20.

The second stop mechanism 42 includes: a second resilient member 421 and a stop pin 422. The stop pin 422 is located at an open end of the second receiving hole 34 and resiliently urged by the second resilient member 421. The stop pin 422 is formed thereon with a slot 423 through which the operative pin 43 received in the third receiving hole 35 inserts.

Figure 4:
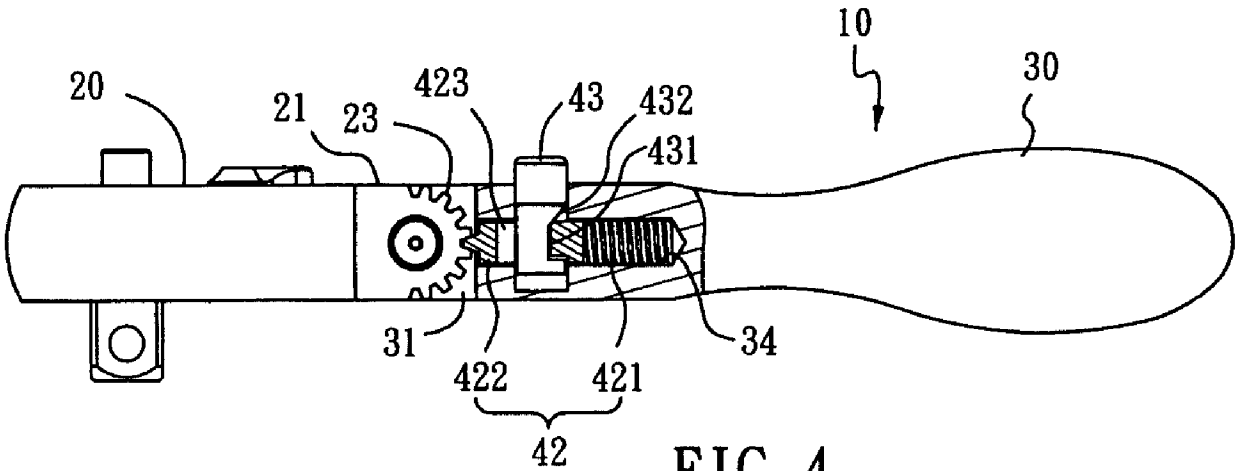
FIG. 4 is a cross-sectional view taken along lines 4—4 of FIG. 3, illustrating a state where the stop pin engages with one of the teeth formed on the head.
Figure 5:
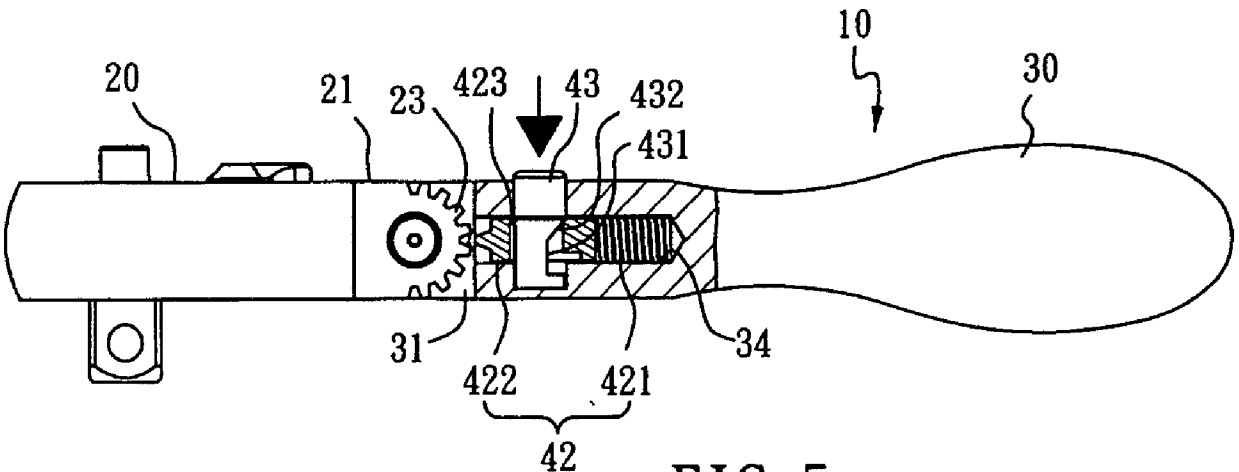
FIG. 5 is a schematic view illustrating a state where the stop pin disengages from the teeth formed on the head.

With reference to FIGS. 1, 4 and 5, the operative pin 43 is formed, at a location where the operative pin 43 contacts the stop pin 422, with an indent 431 and a slope 432 extending from an indent bottom towards a periphery of the operative pin 43.

Figure 3:
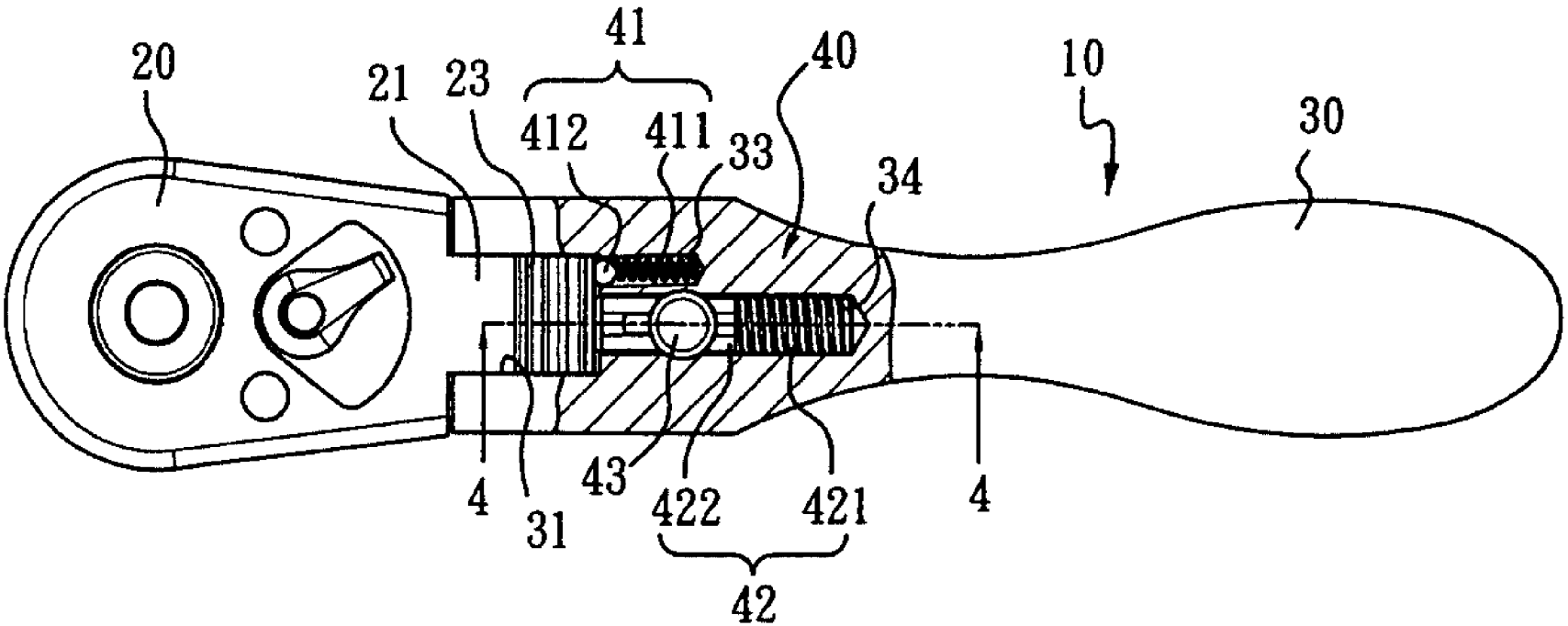
FIG. 3 illustrates a top, partial cross-sectional view of the hand tool having a positioning and locking joint according to this invention to illustrate the construction of the joint.

FIG. 3 illustrates a state where the positioning and locking joint 40 is assembled to the hand tool. FIG. 4 illustrates a state where the stop pin 43 engages with one of the teeth 23 formed on the lip 21 of the head 20. Under this state, part of the slot 423 of the stop pin 422 adapts to engage the indent 431 of the operative pin 43. FIG. 4 illustrates the state at which the head 20 is located on the same horizontal level of the handle 30.

To adjusted orientation of the head 20 with respect to the handle 30, with reference to FIG. 5, the operative pin 43 is pushed downwards according to the direction shown by the arrow. At this time, the slope 432 of the operative pin 43 adapts to drive the slot 423 of the stop pin 422, causing the stop pin 422 to disengage from the teeth 23 formed on the lip 21 of the head 20.

The user may then apply a force, at this time, to overcome the resilience of the resilient member 412 for rotating the head 20 about the handle 30, thereby causing the ball 412 to disengage from the tooth 23 with which the ball 412 originally engages, and subsequently causing the ball 412 to engage with another tooth 23.

After the head 20 reaches the desired orientation, the user then releases the operative pin 43, such that stop pin 422 can recover to a state at which the stop pin 422 engages with one of the teeth 23 formed on the lip 21 of the head 20 by means of the second resilient member 421, so as to retain the head 20 at the desired orientation with respect to the handle 30.

Figure 6:
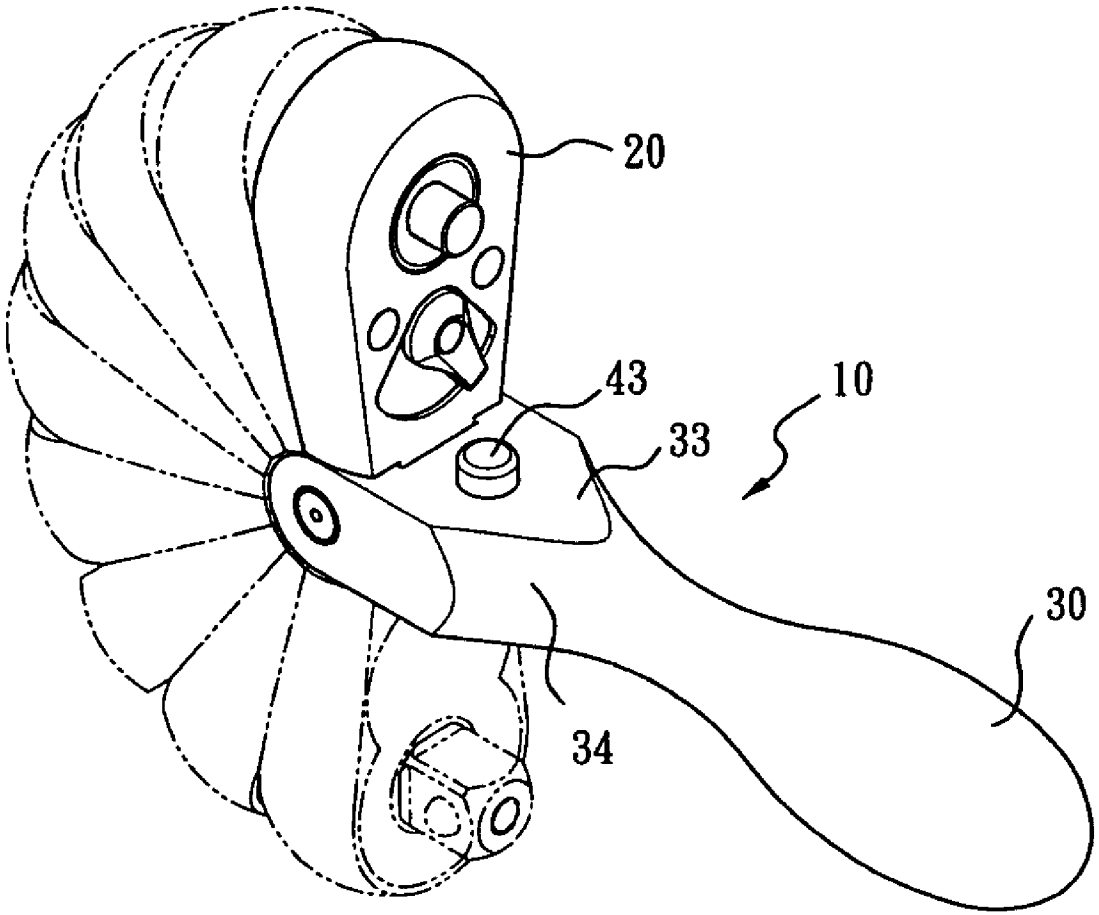
FIG. 6 is a schematic view illustrating the different operation orientations of the hand tool having a positioning and locking joint according to this invention.

FIG. 6 is a schematic view illustrating the different operation orientations of the hand tool having the positioning and locking joint 40 according to this invention.

In this invention, regardless of whether the stop pin 422 is engaged with or disengaged from the teeth 23 formed on the lip 21 of the head 20, the ball 412 urged by the first resilient member 411 is constantly and resiliently urged against one of the teeth 23 formed on the head 20. Hence, even if the user does not support the box by one's hand when the stop pin 422 is disengaged from the teeth formed on the lip 21 of the head 20, the head 20 cannot rotate downwards due to the gravitational force working on the head per se.

In addition, when the user intends to rotate the head 20 about the handle 30 to a desired orientation, the ball 412 constantly urged by the first resilient member 411 to engage one of the teeth 23 ensures proper alignment between the stop pin 422 and the tooth 23 at the desired orientation, so as to prevent improper wear caused to the teeth 23 and the stop pin 422.

Furthermore, according to the present invention, because the operative pin 43 is provided at a location allowing the user to perform an easy push operation, the user may easily push the operative pin 43 using his thumb to allow single-hand manipulation.

This invention is related to a novel creation that makes a breakthrough in the art. Aforementioned explanations, however, are directed to the description of preferred embodiments according to this invention. Since this invention is not limited to the specific details described in connection with the preferred embodiments, changes and implementations to certain features of the preferred embodiments without altering the overall basic function of the invention are contemplated within the scope of the appended claims.

LIST OF REFERENCE NUMERALS

10 wrench
20 head/box
21 lip
22, 32 axial holes
23 teeth
30 handle
31 recess
33 first receiving hole
34 second receiving hole
35 third receiving hole
40 positioning and locking joint
41 first stop mechanism
42 second stop mechanism
43 operative pin
50 shaft
411 first resilient member
412 ball
421 second resilient member
422 stop pin
423 slot
431 indent
432 slope

What is claimed is:

1. A hand tool having a positioning and locking joint, comprising: a head provided at an end thereof with an arcuate face, on the arcuate face being formed with a plurality of teeth; a handle, connected to the head in a manner allowing rotating movement in relation to the head, the handle being formed with a first receiving hole, a second receiving hole and a third receiving hole communicating with the second receiving hole; and a positioning and locking joint, including: a first stop mechanism received in the first receiving hole, the first stop mechanism having an end constantly urging against one of the teeth formed on the head; a second stop mechanism received in the second receiving hole, the second stop mechanism having an end selectively engaging with one of the teeth formed on the head; and an operative pin received in the third receiving hole for controlling the second stop mechanism to engage with or disengage from one of the teeth formed on the head, wherein the first stop mechanism includes a first resilient member; and a ball, located at an open end of the first receiving hole and resiliently urged by the first resilient member so as to resiliently urge against one of the teeth formed on the head.

2. A hand tool having a positioning and locking joint, comprising: a head provided at an end thereof with an arcuate face, on the arcuate face being formed with a plurality of teeth; a handle, connected to the head in a manner allowing rotating movement in relation to the head, the handle being formed with a first receiving hole, a second receiving hole and a third receiving hole communicating with the second receiving hole; and a positioning and locking joint, including: a first stop mechanism received in the first receiving hole, the first stop mechanism having an end constantly urging against one of the teeth formed on the head; a second stop mechanism received in the second receiving hole, the second stop mechanism having an end selectively engaging with one of the teeth formed on the head; and an operative pin received in the third receiving hole for controlling the second stop mechanism to engage with or disengage from one of the teeth formed on the head, wherein the second stop mechanism includes a second resilient member; and a stop pin, located at an open end of the second receiving hole and resiliently urged by the second resilient member, the stop pin being formed thereon with a slot through which the operative pin received in the third receiving hole inserts.

3. The hand tool having a positioning and locking joint according to claim 2, wherein the operative pin is formed, at a location where the operative pin contacts the stop pin, with an indent and a slope extending from an indent bottom towards a periphery of the operative pin.

4. The hand tool having a positioning and locking joint according to claim 3, wherein the head is formed with a lip projecting from an end thereof, on the lip being formed with the arcuate face.

5. The hand tool having a positioning and locking joint according to claim 4, wherein a recess is formed on an end of the handle connected to the head for receiving the lip, the recess being formed at an inside thereof with the first receiving hole and the second receiving hole.

6. The hand tool having a positioning and locking joint according to claim 5, wherein the lip of the head and the recess of the handle are each formed with at least one axial hole through which a shaft passes.

* * * * *